United States Patent [19]

Nagy de Nagybaczon et al.

[11] Patent Number: 4,741,918

[45] Date of Patent: May 3, 1988

[54] COATING PROCESS

[75] Inventors: Erno Nagy de Nagybaczon, London; Alan C. Paterson, Sharpthorne, both of England

[73] Assignee: Tribohesion Limited, London, England

[21] Appl. No.: 779,774

[22] PCT Filed: Jan. 24, 1985

[86] PCT No.: PCT/GB85/00034

§ 371 Date: Nov. 4, 1985

§ 102(e) Date: Nov. 4, 1985

[87] PCT Pub. No.: WO85/03244

PCT Pub. Date: Aug. 1, 1985

[30] Foreign Application Priority Data

Jan. 24, 1984 [GB] United Kingdom ..... 8401838

[51] Int. Cl.[4] ..... B05D 1/02

[52] U.S. Cl. ..... 427/11; 427/180; 427/194; 118/249

[58] Field of Search ..... 427/11, 180, 194; 118/249

[56] References Cited

U.S. PATENT DOCUMENTS

| | | | |
|---|---|---|---|
| 461,667 | 10/1891 | Chatfield | 427/197 |
| 3,041,140 | 6/1962 | Alexander | 427/11 X |
| 3,075,279 | 1/1963 | Haltner et al. | 427/11 X |
| 3,669,705 | 6/1972 | Morrison | 427/11 |
| 4,159,352 | 6/1979 | Martin | 427/11 |
| 4,161,250 | 7/1979 | Pierce | 427/197 |
| 4,390,562 | 6/1983 | Yanagisawa . | |
| 4,391,854 | 7/1983 | Kanda et al. | 427/194 X |
| 4,485,757 | 12/1984 | Ebner | 427/180 X |

FOREIGN PATENT DOCUMENTS

| | | |
|---|---|---|
| 3040669 | 6/1982 | Fed. Rep. of Germany . |
| 863087 | 3/1961 | United Kingdom . |
| 2025793 | 1/1980 | United Kingdom . |

*Primary Examiner*—Shrive P. Beck

*Attorney, Agent, or Firm*—Cushman, Darby & Cushman

[57] ABSTRACT

A abstract is coated with a coating material by rubbing substantially dry discrete particles of the coating material across the surface of the substrate with a sufficient rate of energy input to cause them to adhere. Preferably, the particles are carried on the surface of a soft, resilient buffing wheel rotating sufficient rapidly to give peripheral speeds of from 2 to 200 m/s. Exemplified coating materials include metals, metal oxides and plastics.

2 Claims, 2 Drawing Sheets

COATING PROCESS

This invention relates to a process for depositing thin films of coating material onto a substrate, and to substrates having thin film coatings thereon.

Thin films have an enormously varying range of industrial applciations. For example, thin films of gold, silver and chromium are used for decorative purposes, thin films of aluminium and nickel-boron have been used for corrosion protection, and thin films of magnesium fluoride, aluminium oxide and silicon oxide have all been used as non-reflective coatings for optical lenses.

Kirk-Othmer's "Encyclopaedia of Chemical Technology", 3rd Edition (1980) Vol. 10, pages 247 to 283 describes the following types of process for depositing thin films:

A. Deposition of Films from Solution
  1. Electrolytic deposition—cathodic and anodic films.
  2. Chromate conversion coatings.
  3. Electroless plating.
  4. Polymeric coatings.

B. Vacuum Deposition of Films
  1. Evaporation of inorganic materials.
  2. Evaporative coating with polymers.
  3. Vapour-phase polymerisation.
  4. Sputtering.
  5. R-f sputtering of polymers.
  6. Ultra-violet irradiation, photopolymerisation.

C. Deposition of Films in Gaseous Discharge

D. Deposition of Films at Atmospheric Pressure
  1. Metallo-organic deposition.
  2. Electron-beam polymerisation.
  3. Gamma irradiation.
  4. UV solid polymerisation.

The present invention provides a method of depositing films which falls into none of the above-mentioned categories. The method has application to a vast range of substrates and coating materials, and produces a type of thin film which is believed to be unique.

The present invention is based on the unexpected discovery that thin films of unprecedented characteristics can be made merely by rubbing small particles of a coating material (such as copper) with sufficient force across the surface of a substrate (such as a sheet of glass). Our investigations have shown that the bond obtained between the copper coating and the glass substrate in the above-mentioned example was not merely the result of mechanical keying between the copper and microscopic rugosities on the surface of the substrate, but is a quite different kind of bond which is only achieved at or beyond certain critical rates of energy input. This was demonstrated by an experiment in which copper particles were rubbed across the surface of glass by means of a rotating buffing wheel, while gradually increasing the force with which the wheel was pressed against the glass. Measurement of the frictional force acting on the glass, (i.e. the force acting on the glass in a direction tangential to the circumference of the wheel) gave a most unexpected result. It was found that the frictional force increased gradually, and generally in proportion to the load on the glass, until a critical load was reached. At this point the frictional force increased very markedly upon only slight increase in the applied load. It was only at and beyond this point that copper was deposited on the glass. Had the bond between the copper coating and the substrate been merely the result of mechanical keying, it might have been expected that the extent of coating would have increased gradually with the applied load.

It is therefore believed that the copper coating described above is totally unrelated in character to the type of coating which may be formed by drawing a relatively soft material across a microscopically or macroscopically rough surface, so that fragments of the soft material are mechanically held in fissures or on microscopic protuberances in or on the coated surface. Examples of such mechanically keyed coatings are those obtained when waxes are applied to wood, graphite or paper, and when copper is applied to iron or steel as described in U.S. Pat. No. 826,628.

The exact nature of the copper/glass bond obtained in the experiments described above is imperfectly understood. However, it is thought that the critical conditions of roller pressure and peripheral speed represent the conditions necessary to remove contaminants from the surface of the substrate, and to present fresh copper particles to the decontaminated surface before recontamination can occur. In the extremely short period of time for which the surface remains uncontaminated, the surface molecules are thought to be in some way activated, and highly receptive to any molecule with which they might come into contact.

A possible alternative mechanism is that under the very high energy conditions which obtain at interface between the particle of coating material and the substrate, an intimate molecular mixture or complex is formed between the coating material and the material of the substrate, analogous to a metallic alloy, nonwithstanding that the two materials would not normally form an alloy with each other.

A similar mechanism of film formation to the first mechanism propounded above is apparently disclosed in U.S. Pat. No. 2,640,002. In the introductory passages of this specification, it is suggested that an "atomic bond" can be created between a metallic coating and a metallic substrate by dry tumbling the metallic substrate, crushed iron shot or the like, and metal dust (such as zinc dust) in a barrel. However, it is believed that the bond which is in fact obtained is merely mechanical in character, because it is said in U.S. Pat. No. 2,640,002 to be necessary to the plating mechanism that the surface of the substrate be sufficiently rough.

Other instances of coatings being formed by rubbing a coating material across the surface of a substrate are also to be found in the prior art. For example, U.S. Pat. No. 2,284,590 discloses a method of applying a plastic material to a curved surface, and more particularly to a method of applying a coating of polyvinyl alcohol or polyvinylacetal to a headlight lens. The method involves rubbing a belt of the plastic material across the surface of the substrate until a coating is formed. It is believed, however, that the mechanism of film formation in this case is also quite different from the mechanism of film formation by the process of the present invention. Firstly, U.S. Pat. No. 2,284,590 indicates that the method may be practised by merely stroking the substrate with a mass of polyvinyl alcohol held in the hand of the operator. In contrast, we have found that power necessary to deposit a coating by the method of the present invention is many times (e.g. from 10 to 100 times) that which can be achieved manually. Secondly, U.S. Pat. No. 2,284,590 suggests that the coating mechanism involves gross melting of the PVA belt, whereas the method of the present invention has been found to be applicable to the formation of coatings to materials which have melting points substantially above the melting point of PVA, for example, materials having melting points of 300° C. or more, and more particularly to materials having melting points above 500° C. In some cases, we have found that coatings can be formed using materials having melting points over 800° C., and even over 1000° C. Most remarkably, the process of the present invention has been used to obtain coatings of materials which decompose before melting or which are not normally thought of as having any melting point, such as diamond. Thirdly, the implication of U.S. Pat. No. 2,284,590 is that melting alone is sufficient to effect a bond between the plastic film and the substrate, whereas the process of the present invention has been found to be applicable to the formation of adherent coatings on substrates to which the coating material will not normally adhere, even when molten.

A further type of coating disclosed in the prior art as being obtained by means of rubbing is that disclosed in U.S. Pat. No. 3,041,140. This specification discloses the formation of non-reflecting coatings on glass lenses by rubbing very fine powders of silica using light pressure. Again, it is believed that the mechanism of film formation in this prior art specification is quite unrelated to the mechanism of film formation in the process of the present invention. Firstly, the energies needed for forming the prior art coating are very much smaller than those typically used in the process of the present invention. Secondly, the present invention has been found to be applicable to the formation of coatings even on substrates for which the coating material would not normally be regarded as having any chemical affinity.

As noted above, we have found that coatings of an enormous range of materials can be deposited merely by rubbing with sufficient force and at sufficient speed across the surface of the desired substrate. In each case, we have observed the same phenomena of the coating being deposited and the friction increasing greatly, at or above a critical rate of energy input. Accordingly, as used herein, the expression "critical rate of energy input" means the rate of energy input at which these phenomena are observed.

Moreover, in each case the coating formed is very thin, but nonetheless highly adherent, non-granular in appearance and substantially free of micropores. Even in cases when the coating material had a very high melting point, the coating had a characteristic smeared appearance under high magnification scanning electron microscopy, strongly suggesting plastic deformation of the particles of coating material at the time of film formation.

The coatings formed by the method of the present invention have a number of important characteristics. Firstly, they are very thin, being less than 3 microns in thickness. More usually, they are substantially thinner than this, very often being less than 500 nm thick and often less than 200 nm thick. Typical film thicknesses are from 1 to 100 nm thick, for example from 5 to 50 nm thick. A most unusual characteristic of the process of the invention is that in many instances, the coatings produced thereby are effectively self-limiting in thickness, in the sense that the coating, once formed, will generally not increase in thickness even when more of the same coating powder is rubber over the surface.

Another characteristic of the films formed by the process of the invention is that they may be substantially non-porous. This is highly unusual in such thin coatings.

Yet a further characteristic of the coatings formed by the method of the invention is that they are substantially free of voids. This is in marked contrast to the coatings formed by many prior art techniques, such as sputtering.

The present invention thus provides a method of coating a substrate with a coating material, comprising rubbing discrete, substantially dry particles of the coating material across the surface of the substrate with sufficient force and at sufficient speed relative to said surface to cause the coating material to become deposited on the surface of the substrate in an adherent, substantially non-microporous, non-granular thin film. Differently expressed, the invention provides a method of coating a substrate with a coating material, comprising rubbing discrete, substantially dry particles of the coating material across the surface of the substrate with a rate of energy input which is greater than the critical rate of energy input as hereinbefore defined.

According to a further aspect of the present invention, there is provided a substrate having deposited thereon a thin, highly adherent, non-granular, substantially non-microporous smeared coating.

The application of the coating material to the substrate with the requisite rate of energy input may be achieved by bombarding the intended substrate with particles of the coating material carried on the surface of larger particles of the same or different resilient material such as cork e.g. by means of a wheelabrator. The carrier particles may be projected at the surface to be treated by entrainment in a cold or heated high velocity jet of gas. Alternatively, the carrier particles may be caused to vibrate acoustically (ultra-sonically), magnetically or mechanically against a substrate.

Preferably, however, the particles of coating material are rubbed across the surface of the substrate by means of an applicator having a resilient surface which is in sliding contact with the substrate. The applicator may be, for example, a rotary applicator such as a roller or wheel.

Accordingly, the present invention also provides apparatus for coating a substrate using the method, said apparatus comprising a support for the substrate, a rotary applicator arranged to bear against a substrate supported on said support, means for delivering a supply of substantially dry particles of coating material to the surface of the applicator, or of the substrate, or both, and means for rotating the rotary applicator to cause the surface thereof to rub said particles against the substrate, whereby to coat the substrate with the coating material.

A particularly preferred applicator for use in the method of the invention is a jeweller's buffing wheel. Suitable buffing wheels includes those available from W. Canning Materials Limited, Great Hampton Street, Birmingham, England. These buffing wheels generally comprise a plurality of fabric discs clamped together in a way which allow the density of fabric at the periphery of the wheel to be adjusted.

As mentioned above, the coating material can be selected from an enormous variety of materials. For example, it may be an organic polymer. Illustrative examples include; polyolefins such as polyethylene, polypropylene, polybutylene and copolymers of the foregoing; halogenated polyolefins such as fluorocarbon polymers; polyesters such as polyethyleneterepththalate; vinyl polymers such as polyvinylchloride and polyvinyl alcohol; acrylic polymers such as polymethylmethacrylate and polyethylmethacrylate; and polyurethanes. Alternatively, the coating material may be a metal such as gold, silver, platinum, iron, aluminium, chromium or tantalum. Further examples of suitable coating materials include magnetic oxides such as magnetic iron oxide and magnetic chromium dioxide, minerals such as quartz, organic and inorganic pigment, and even such materials as diamond and china clay. Yet further examples include metalloid elements such as phosphorus, silicon, germanium, gallium, selenium and arsenic, optionally doped with other materials to confer desired semiconductor properties.

If desired, mixtures of different kinds of particle may also be used.

Products which may be made by the process of the invention include magnetic recording media and electrical components having conducting resistive, dielectric or semiconducting layers thereon. Other applications include the formation of protective coatings, decorative coatings, sizing coatings, key coats, light or heat absorbing coatings, light or heat reflective coatings, heat conducting coatings, slip coatings, non-slip coatings, anti-corrosion coatings, anti-static coatings and even abrasive coatings on substrates such as metal, paper, glass, ceramics, fabrics and plastics. Yet further applications of the process of the invention are set out in our British Patent Application No. 8401838, filed 24th Jan. 1984.

The particles of coating material will generally be less than 100 microns in size. However, the most appropriate particle size will depend to some extent on the chemical nature of the coating material and on the physical and chemical nature of the substrate. Usually, the particles will have a maximum diameter of less than 50 microns, and more usually a maximum diameter less than 30 microns. For example, the particles may have a maximum diameter of from 0.5 to 30 microns, such as from 1 to 10 microns.

The particles of coating material may be delivered to the surface of the applicator in the dry state, for example in a gas stream, but is often found to be more convenient to deliver the particles to the surface of the applicator in the form of a liquid dispersion, such dispersions being readily controllable. Preferably, the dispersing liquid is sufficiently volatile to evaporate almost instantly, leaving the particles in a substantially dry state. A suitable dispersing liquid is trichlorotrifluoroethane, though other low-boiling halogenated hydrocarbons can also be used, as can other liquids such as water.

The method of the invention can be used for coating virtually any substrate, whether flexible or rigid, smooth or rough. Remarkably, the process may also be used to great advantage for coating paper and woven and nonwoven fabrics (whether of natural fibres such as cellulosic fibres, or synthetic fibres such as polyesters, polyolefins, polyamides and substituted celluloses) and other materials of a soft nature.

When the substrate has an uneven surface, such as the surface of a nonwoven fabric, the coating may be macroscopically discontinuous, in that only the high points of the substrate are coated with a thin, adherent, substantially non-microporous film. However, when such substrates are coated by the method of the invention, it is found that both the micro and macro interstices between and within the fibres are filled with loosely compacted sub-particulate material.

In the case of certain, relatively low-melting coating materials, the sub-particulate material which collects in the interstices in this way may be rendered more coherent and adherent by subsequent sintering or fusing, e.g. flash heating. This flash heating involves the passing of a coated substrate through a nip where at least one roller is heated to the required sintering or fusing temperature If the substrate is one which may be damaged by prolonged exposure to this temperature, the coated substrate has to pass through rapidly so as not to cause scorching or other structural damage. The thicker the deposits which it is desired to sinter or fuse, the longer is the dwell time necessary in the heated nip. Therefore there is a natural restriction on the thickness of sintered or fused coatings which may be formed on substrates which are liable to thermal damage.

In certain cases, the above-described method of flash sintering or fusing will not be appropriate. For example, if a plastics-coated bank note is flash heated using heated rollers, the elevated temperature and pressure at the nip of the heated roller will cause ink at the raised images produced by the Intaglio process to soften and flatten. Consequently it is appropriate in this instance to use a non-contact heat source such as high intensity radiation.

In cases where a sinterable or fusible coating of the invention is deposited on a relatively uneven surface, the thin film which is formed on the high points of the substrate constitutes an anchor to which further layers of coating material may be bonded by conventional sintering or fusing processes.

It will be appreciated that the nature of the present invention is such as to preclude precise enumeration of the appropriate process conditions for forming films of a given material on a given substrate. This is because coatings can be formed using a wide range of process conditions, which are all dependent on each other. Thus, for example, when a buffing wheel is used to rub particles of coating material across the substrate, the pressure applied by the wheel, the area of contact between the wheel and the substrate, the peripheral speed of the wheel, and the relative speed between the surface of the wheel and the substrate may all be varied. However, alteration of any one of these parameters may require that one or more of the other parameters be adjusted in order to compensate.

In addition, of course, the conditions which are appropriate for forming a coating of a given material on a given substrate may not be appropriate for coating a different substrate or for coating with a different coating material. In all cases, however, the appropriate process conditions will be readily determinable by the person skilled in the art, particularly having regard to the guidelines and examples hereindescribed.

Generally, we have found that the more delicate the substrate, the lower the pressure with which the particles of coating material should be pressed against the substrate, in order to avoid damage thereto. Thus, for example, a very lightweight nonwoven fabric may be coated with plastics materials using a 30 cm diameter soft fabric buffing wheel, by training the fabric round the buffing wheel, and applying only a slight tension (e.g. from 10 to 100 grams/cm width of fabric, depending on the strength of the fabric). With this arrangement, the pressure with which the wheel bears against the fabric is very low indeed, for example from less than 1 g/cm$^2$ to a few grams/cm$^2$. However, such low pressures are compensated for by the fact that the individual particles of coating material are drawn over a very substantial length of the nonwoven fabric, such as from one quarter to three quarters of the circumference of the wheel. In the example just described, the roller can conveniently be rotated at 2000 rpm, while the nonwoven fabric web is drawn through at about 10 metres/minute.

When the substrate is rather more robust, such as a a paper of weight 100 g/m$^2$, a convenient coating technique is to feed the substrate into the nip between a buffing wheel and a retaining roller. In this case, the distance for which individual particles of coating material are in contact with the substrate is very much smaller (generally from 1 to 20 mm, e.g. from 2 to 10 mm), and substantially larger pressures are therefore appropriate. Conveniently, the static pressure of the roller on the substrate will be at least 100 g/cm$^2$, preferably at least 200 g/cm$^2$, and more preferably from 300 g/cm$^2$ to 10 kg/cm$^2$, e.g. 500 g/cm$^2$ to 2 kg/cm$^2$.

When even harder to less easily damaged substrates are used, it may be appropriate to use still larger contact pressures between the applicator and the substrate. For example, we have found that for coating metals with other relatively hard materials (such as metals, metal oxides, etc) pressures greater than 1 kg/cm$^2$ may be appropriate. Dynamic pressures of from 2 to 100 kg/cm$^2$ are most frequently used for this kind of coating, for example from 5 to 50 k/cm$^2$.

Although the factors which determine the appropriate operating conditions for different substrates are imperfectly understood, it will be apparent that identifying the appropriate conditions for a given substrate is merely a matter of trial and error. The operator need only choose a coating technique which is appropriate to the strength and flexibility of the substrate in question, and then increase the applicator pressure and/or applicator speed until a desired coating is formed.

A number of embodiments of the invention will now be particularly described with reference to the accompanying drawings in which.

Figure 1:
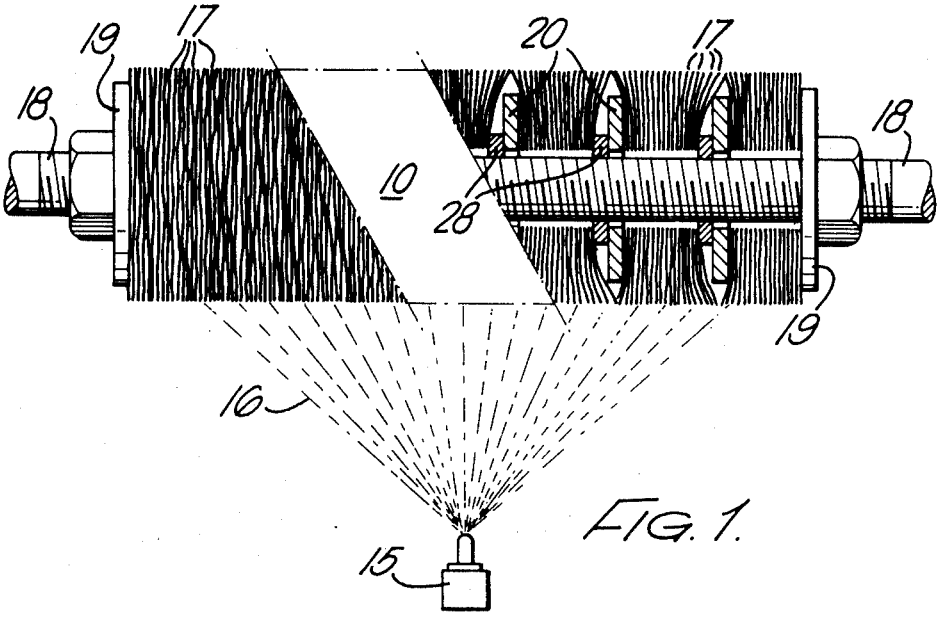
FIG. 1 illustrates diagrammatically a rotary applicator for carrying out the method of this invention.
Figure 2:
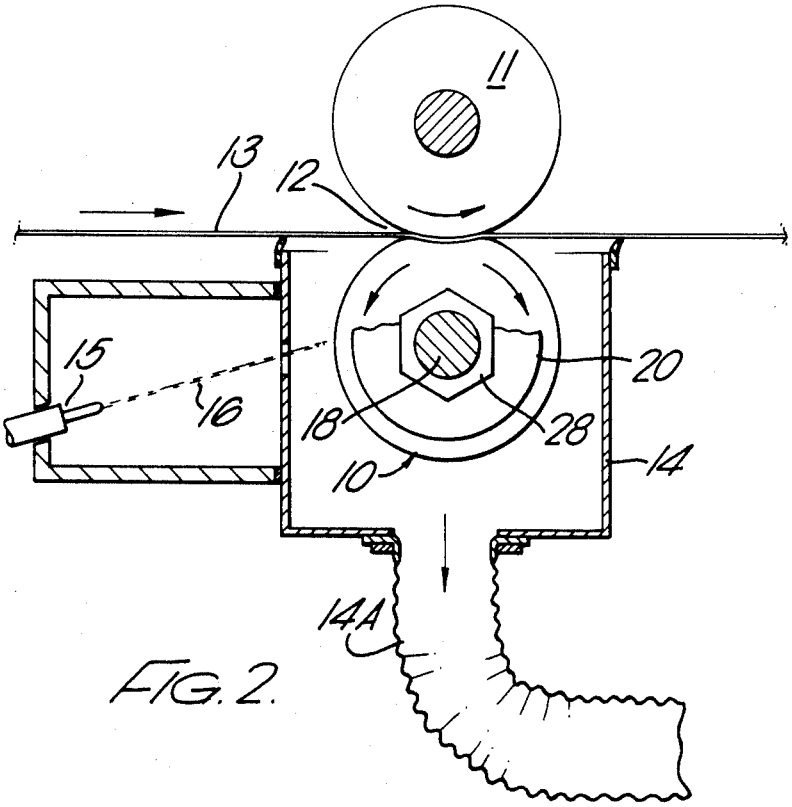
FIG. 2 shows diagrammatically the applicator in the context of apparatus for use in carrying out the method of this invention.

The apparatus shown in FIG. 2 will be carried within a metal frame of such mass and proportions so as to withstand the loadings and stresses imposed upon it by the operation. A rotary motive power unit, in this case an electric motor (not shown), capable of delivering rotational speeds at the torque necessary for the operation, is mounted to drive the apparatus. Within this description we shall consider only the coating of a moving web of approximately 20 cm width. The apparatus therefore also requires the means of conveying the web through the apparatus.

At the heart of the apparatus of the present example are two rollers 10, 11 forming a nip 12 through which the substrate 13 must pass. One of these rollers 10 is the applicator and the other is the retainer 11. The retainer roller rotates in the same direction as the web is travelling. The applicator roller is driven and rotates so that its surface in the region of the nip moves in the same direction as the web, but at a different speed, or in the opposite direction, all as indicated by arrows in FIG. 2.

The two rollers 10, 11 are mounted within the frame in such a way that the centre lines of their axis may be moved relative to each other and possess the necessary facility to be firmly fixed in the desired position after the correct nip pressure has been set.

Apart from the small segment of its circumference at the nip and the aperture required through which the coating material is conveyed or any surplus which may be extracted via a flexible duct 14A, the applicator is contained in an enclosure 14.

The coating material may be applied to the applicator by any means so long as the particulate material is in a dry form when it reaches the nip and it is uniformly deposited over the face of the applicator.

In the present example an airless spray 15 is used to convey the particles of coating material at a nozzle pressure of 480 P.S.I. Although in the above-mentioned airless spray the particles are dispersed in a solvent, which being FREON (Registered Trade Mark) TF is highly volatile and is thought to "flash off" almost completely before the particles hit the surface of the applicator, the preferred method is to apply the coating material uniformly in a dry particulate state. One benefit of using the dry particulate state is to avoid using solvents which are unattractive for commercial and environmental reasons.

The airless spray is equipped with a switch mechanism (not shown) which is operated by a can which is rotating at 38 RPM and has lifting knobs having an effective operating dwell of 3° arc on the cam. The number of lifting knobs used is determined by the surface roughness of the substrate and or the quantity of particulate material that is desirable to be deposited on the substrate.

The spray nozzle is adjusted to produce a fan-shaped spray pattern 16 in which the particles are evenly distributed when they contact the applicator roller 10. The applicator roller 10 and the spray cam (not shown) are linked through gearing in such a way that with each squirt of the nozzle approximately one quarter of the applicator's surface area along its circumference receives a deposit of the coating material and 40 revolutions later the applicator receives a second squirt of material which should land on the second quadrant and so forth.

The applicator is made from sheets of cotton fabric 17 cut in 10 cm diameter discs with a hole in the centre of each disc of 2.5 cm diameter. These cotton discs are then pulled onto a threaded steel shaft 18 of 2.5 cm diameter and are retained by 6 mm thick steel washers 19 of 8.9 cm diameter to form an applicator 30 cm wide. The washers in turn are retained by suitable nuts. The cotton discs are compacted by tightening the retaining nuts to produce a density at the perimeter face of the compacted cotton mass appropriate to the material to be coated. We have found that delicate substrates require softer rollers than resilient substrates. When using polyester films to be of sufficient density for use on a polyester film when it cannot be compressed by more than 6 mm when reasonable thumb pressure is applied.

When a softer applicator is desired intermediate nuts 18 and washers 20 may be used on the shaft at say every 1 to 2 cm along the length of the applicator. Alternatively, the nuts may be tightened further in order to compact the cotton sheets into a more solid mass.

Once the correct applicator density is achieved it is then ground in by running it at high speed against the retaining roller, the surface of which is closely covered with a sheet or coarse abrasive material such as emery cloth and running in a counter direction to the rotation of the applicator for 1 to 2 hours or until such time as a smooth enough surface corresponding to the contours of the retainer roller is produced. Following this operation the coarse abrasive material is removed and the deposition process is ready to commence.

Depending on the substrate to be coated, the retaining roller may have a resilient or a hard surface.

Figure 3:
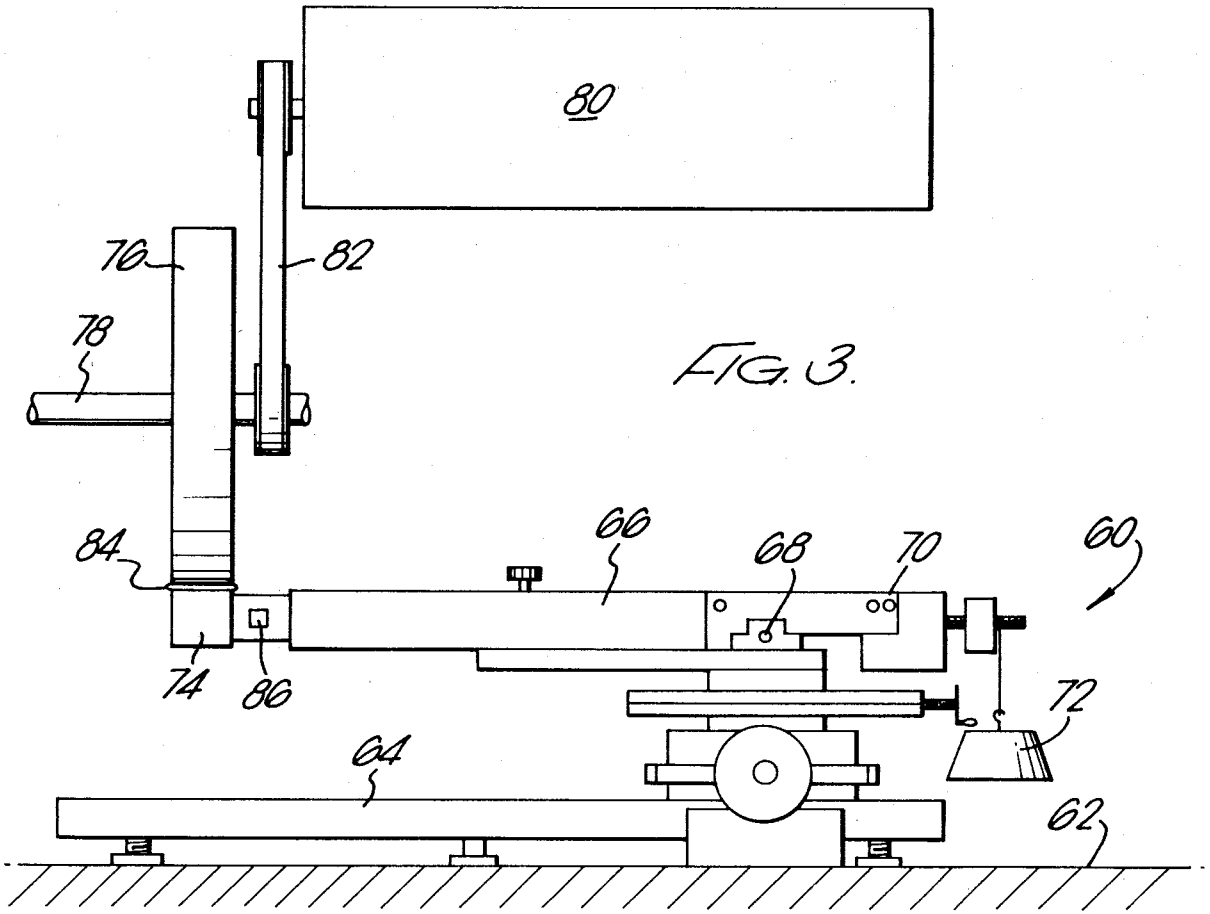
FIG. 3 shows diagrammatically a form of apparatus suitable for determining the frictional force acting on a substrate when being coated by the method of the invention.

In FIG. 3, there is shown a test rig 60 mounted on a firm level surface 62. The test rig comprises a base portion 64 to which is attached an arm 66, mounted for pivotal movement about pivot 68. One end 70 of arm 66 carries a weight 72 for biassing the other end 74 of arm 66 against a felt applicator disc 76 (30 cm dia.×5 cm). The applicator disc is rotatably mounted on spindle 78, and is connected to electric motor 80 by means of belt drive 82.

The operation of the test rig is as follows: A sample 84 of the desired substrate is interposed between the arm 66 and applicator disc 76. Particles of the desired coating material are applied to the cylindrical surface of the disc, and the disc is driven at an arbitrarily chosen speed, for example 3000 r.p.m. The force with which the applicator disc 76 bears against the sample 84 is gradually increased by increasing the weight 72. The frictional force acting on the substrate in a direction tangential to the disc (e.g. out of the plane of the paper in FIG. 3) is continuously monitored by means of strain gauges 86 (only one shown) on either side of arm 66, using a carrier wave frequency bridge connected to a chart recorder. When the load on the substrate is sufficiently great for coating to take place, the strain measured by the strain gauges suddenly increase.

For commercial purposes, it will usually be desired to coat the substrate on a continuous basis by driving it past the applicator. For this purpose, it may be desirable to modify the apparatus of FIG. 3 so as to simulate more closely the dynamics of such a continuous process. This can be done by causing the test rig 60, or at least arm 66 to traverse in a direction tangential to the disc.

The invention is now further illustrated by the following examples:

EXAMPLE 1

A hard felt applicator disc (W. Canning Materials Ltd., 12" (30.5 cm)×2" (5.1 cm)) was used to rub particles of polymethylmethacrylate (PMMA) over a glass plate, using the rig of FIG. 3. The PMMA particles were of 5 microns average diameter. With the applicator disc turning at 1700 r.p.m., a load of 7.5 kg hung on the arm was found to be adequate to cause an adherent coating of PMMA to be deposited on the glass. The film was estimated to have a thickness of <20 nm, and had a smooth appearance with no micropores visible under scanning electron microscopy at 2000× and 12,000× magnification.

The area of contact between the disc and the plate was estimated to be about 0.4 to 0.5 $cm^2$, and the apparent dynamic roller pressure is therefore estimated to be approximately 8.5 $kg/cm^2$.

EXAMPLE 2

The procedure of Example 1 was repeated, except that the glass plate was traversed across the applicator disc at speed from 0.1 to 10 cm/sec. It was found that satisfactory coatings were still formed, but higher roller pressures were found to be desirable at the higher traverse speeds.

EXAMPLE 3

Example 1 was repeated, using 1 to 10 micron diameter iron powder instead of PMMA, and increasing the roller speed to 3000 r.p.m. A load of 4 kg was found to be sufficient to cause the iron to be deposited in a film which was estimated to be 10 nm thick. Scanning electron microscopy at 2000×and 12,000×magnification showed it to have the smeared, non-microporous, non-granular appearance which is characteristic of coatings according to the invention.

EXAMPLE 4

Example 3 was repeated using 0.5 to 20 micron diameter copper particles instead or iron powder. A load of 5 kg was found to be sufficient to cause coating with the applicator disc turning at 3000 r.p.m., but a load of 7 kg was required at 2640 r.p.m.

In each case, the coating had an estimated thickness of <25 nm.

EXAMPLE 5

Example 3 was repeated using alumina powder (particle size, 1–10 microns). Coating occurred at an applicator disc loading of 3 kg.

EXAMPLE 6

Example 3 was repeated using diamond dust (particle size, <1 microns). Coating occurred with the usual characteristic increase in friction between the applicator and the glass, at a load of 4 kg.

EXAMPLE 7

The general procedure of Example 1 was followed, using a felt applicator disc of diameter 20.3 cm and thickness 3.2 cm, to apply iron powder to a polished aluminium plate. A coating of thickness <25 nm was obtained at a load of 10 kg.

EXAMPLE 8

When the product of this Example was heated in a flame, the aluminium coated with iron was found to be markedly more resistant to melting than uncoated aluminium.

Example 7 was repeated using copper powder instead of iron powder. A coating of estimated thickness <25 nm was obtained at a load of 8 kg.

EXAMPLE 9

Uncoated, unsized paper of 105 $g/m^2$ (manufactured by Tullis Russell) was coated with PMMA using a soft fabric roller (10 cm diam×30 cm) in the apparatus of FIG. 2. The static pressure applied by the applicator roller was estimated to be 0.8 $kg/cm^2$, and the roller was rotated at 1600 r.p.m. The paper web was delivered to the nip between the applicator roller and the retainer roller at a speed of 10 metres/min. Satisfactory coatings were also obtained both at higher and lower web speeds, e.g. from 0.1 to 100 m/min.

Our copending application, Ser. No. 779,772 filed 9-23-85, entitled "PTFE Coating Process", discloses yet further examples of suitable operating conditions for forming coatings on substrates. While the said copending application is concerned exclusively with PTFE coatings, the operating parameters exemplified therein will also be applicable to the formation of other plastics coatings within the scope of the present invention.

It will be understood that the present invention has been described above purely by way of example, and modifications of detail may be made without departing from the scope of the invention.

What is claimed is:

1. A method of coating a paper, fabric or plastic substrate with a material other than PTFE, comprising rubbing discrete substantially dry particles of the coating material with a rotary applicator, which is in sliding contact with the substrate, across the surface of the substrate with sufficient force and at sufficient speed relative to said surface to cause the material to become deposited on the surface of the substrate in an adherent film, which film is non-microporous and is non-granular in appearance.

2. A method according to claim 1, wherein the particles are less than 100 microns in diameter.

* * * * *